United States Patent [19]

Broze et al.

[11] Patent Number: 4,797,225

[45] Date of Patent: Jan. 10, 1989

[54] NONAQUEOUS LIQUID NONIONIC LAUNDRY DETERGENT COMPOSITION CONTAINING AN ALKALI METAL DITHIONITE OR SULFITE REDUCTION BLEACHING AGENT AND METHOD OF USE

[75] Inventors: Guy Broze, Grace-Hollogne; Danielle Bastin, Soumagne, both of Belgium

[73] Assignee: Colgate-Palmolive Company, New York, N.Y.

[21] Appl. No.: 904,327

[22] Filed: Sep. 8, 1986

[51] Int. Cl.[4] ..... C11D 7/54; D06L 3/00

[52] U.S. Cl. ..... 252/105; 252/95; 252/188.22; 252/174.22; 252/100; 252/142; 252/DIG. 14

[58] Field of Search ..... 252/105, 188.22, 188.21, 252/188.23, 174.22, DIG. 14, 100, 142

[56] References Cited

U.S. PATENT DOCUMENTS

| | | | |
|---|---|---|---|
| 3,940,341 | 2/1976 | Gray et al. | 252/105 |
| 4,195,974 | 4/1980 | Kothe | 252/105 |
| 4,622,173 | 11/1986 | Broze et al. | 252/528 |
| 4,647,393 | 4/1987 | Ouhadi et al. | 252/102 |
| 4,648,983 | 4/1987 | Broze et al. | 252/135 |
| 4,655,954 | 4/1987 | Broze et al. | 252/102 |
| 4,661,280 | 4/1987 | Ouhadi et al. | 252/99 |
| 4,690,771 | 9/1987 | Ouhadi et al. | 252/102 |

*Primary Examiner*—Paul Lieberman
*Assistant Examiner*—John F. McNally
*Attorney, Agent, or Firm*—M. M. Grill; N. Blumenkopf

[57] ABSTRACT

A liquid laundry detergent composition containing an alkali metal dithionite or sulfite reduction bleaching agent. The preferred compositions are nonaqueous liquids based on liquid nonionic surfactants and include a detergent builder salt suspended in the liquid nonionic surfactant. The alkali metal dithionite or alkali metal sulfite reduction bleaching agent can also be used as the bleaching agent in powdered or granular detergent compositions.

21 Claims, No Drawings

NONAQUEOUS LIQUID NONIONIC LAUNDRY DETERGENT COMPOSITION CONTAINING AN ALKALI METAL DITHIONITE OR SULFITE REDUCTION BLEACHING AGENT AND METHOD OF USE

BACKGROUND OF THE INVENTION (1) Field of Invention

This invention relates to nonaqueous liquid fabric treating compositions. More particularly, this invention relates to liquid nonionic laundry detergent compositions which contain an alkali metal dithionite or alkali metal sulfite reduction bleaching agent. The compositions are stable against phase separation and gelation and are easily pourable. The compositions are used for cleaning soiled fabrics.

(2) Discussion of Prior Art

Liquid nonaqueous heavy duty laundry detergent compositions are well known in the art. For instance, compositions of that type may comprise a liquid nonionic surfactant in which are dispersed particles of a builder, as shown for instance in the U.S. Pat. Nos. 4,316,812, 3,630,929 and 4,264,466 and British Pat. Nos. 1,205,711, 1,270,040 and 1,600,981.

The related pending applications assigned to the common assignee are:

U.S. Ser. No. 717,726, filed Mar. 29, 1985 (IR 270 LG)—describes a liquid nonionic laundry detergent composition containing a perborate bleach, a bleach activator, and hydroxylamine sulfate as a bleach stabilizer and specifically as an inhibitor of catalase.

U.S. Ser. No. 597,793, filed Apr. 6, 1984 (IR 764 f)—describes a nonaqueous liquid nonionic surfactant detergent composition comprising a suspension of a builder salt and containing an acid terminated nonionic surfactant (e.g., the reaction product of a nonionic surfactant and succinic anhydride) to improve dispersibility of the composition in an automatic washing machine.

U.S. Ser. No. 687,815, filed Dec. 31, 1984 (IR 229 LG)—describes a nonaqueous liquid nonionic surfactant detergent composition comprising a suspension of builder salt and containing an alkylene glycol mono-alkyl ether as a viscosity and gel control agent to improve dispersibility of the composition in an automatic washing machine.

U.S. Ser. No. 597,948, filed Apr. 9, 1984 (IR 744 f)—describes a nonaqueous liquid nonionic surfactant detergent composition comprising a suspension of polyphosphate builder salt and containing an alkanol ester of phosphoric acid to improve stability of the suspension against settling in storage.

These applications are directed to liquid nonaqueous nonionic laundry detergent compositions.

The conventionally used heavy duty liquid and dry powder detergent compositions are based on oxidative stain bleaching using chlorine bleach compounds or using peroxide bleach compounds. Chlorine bleaches are typified by sodium hypochlorite (NaOCl), potassium dichloroisocyanurate (59% available chlorine), and trichloroisocyanuric acid (95% available chlorine). Oxygen bleaches are represented by percompounds which liberate hydrogen peroxide in solution. Examples include sodium and potassium perborates, percarbonates, and perphosphates, and potassium monopersulfate.

The peroxygen compound is usually used in admixture with an activator therefor. Suitable activators which can lower the effective operating temperature of the peroxide bleaching agent are disclosed, for example, in U.S. Pat. No. 4,264,466 or in column 1 of U.S. Pat. No. 4,430,244. Polyacylated compounds such as tetraacetyl ethylene diamine (TAED) and pentaacetyl glucose are used as bleach activators. Other activators include acetylsalicylic acid derivatives, ethylidene benzoate acetate, ethylidene carboxylate acetate, alkyl and alkenyl succinic anhydride, tetraacetylglycouril (TAGU), and the derivatives of these.

The bleach activator interacts with the peroxygen compound to form a peroxyacid bleaching agent in the wash water. A sequestering agent of high complexing power is generally added to inhibit any undesired reaction between such peroxyacid and hydrogen peroxide in the wash solution in the presence of metal ions.

Suitable sequestering agents for this purpose include the sodium salts of nitrilotriacetic acid (NTA), ethylene diamine tetraacetic acid (EDTA), diethylene triamine pentaacetic acid (DETPA), diethylene triamine pentamethylene phosphonic acid (DTPMP) sold under the tradename Dequest 2066; and ethylene diamine tetramethylene phosphonic acid (EDITEMPA).

In order to avoid loss of peroxide bleaching agent, e.g. sodium perborate, resulting from enzyme-induced decomposition, such as by catalase enzyme, the compositions may additionally include an enzyme inhibitor compound, i.e. a compound capable of inhibiting enzyme-induced decomposition of the peroxide bleaching agent. Suitable inhibitor compounds are disclosed in U.S. Pat. No. 3,606,990. A specific inhibitor compound that can be used is hydroxylamine sulfate and other water-soluble hydroxylamine salts.

Liquid detergents are often considered to be more convenient to employ than dry powdered or particulate products and, therefore, have found substantial favor with consumers. They are readily measurable, speedily dissolved in the wash water, capable of being easily applied in concentrated solutions or dispersions to soiled areas on garments to be laundered and are nondusting, and they usually occupy less storage space. Additionally, the liquid detergents may have incorporated in their formulations materials which could not stand drying operations without deterioration, which materials are often desirably employed in the manufacture of particulate detergent products. Although they are possessed of many advantages over unitary or particulate solid products, liquid detergents often have certain inherent disadvantages too, which have to be overcome to produce acceptable commercial detergent products. Thus, some such products separate out on storage and others separate out on cooling and are not readily redispersed. In some cases the product viscosity changes and it becomes either too thick to pour or so thin as to appear watery. Some clear products become cloudy and others gel on standing.

The present inventors have been involved in studying the behavior of nonionic liquid surfactant systems with particulate matter suspended therein. Of particular interest has been nonaqueous built laundry liquid detergent compositions and the problem of settling of the suspended builder and other laundry additives as well as the problem of gelling associated with nonionic surfactants. These considerations have an impact on, for example, product stability, pourability and dispersibility.

It is known that one of the major problems with built liquid laundry detergents is their physical stability. This problem stems from the fact that the density of the solid particles dispersed in the nonionic liquid surfactant is higher than the density of the liquid surfactant.

Therefore, the dispersed particles tend to settle out. Two basic solutions exist to solve the settling out problem: increase nonionic liquid viscosity and reduce the dispersed solid particle size.

It is known that suspensions can be stabilized against settling by adding inorganic or organic thickening agents or dispersants, such as, for example, very high surface area inorganic materials, e.g. finely divided silica, clays, etc., organic thickeners, such as the cellulose ethers, acrylic and acrylamide polymers, polyelectrolytes, etc. However, such increases in suspension viscosity are naturally limited by the requirement that the liquid suspension be readily pourable and flowable, even at low temperature. Furthermore, these additives do not contribute to the cleaning performance of the formulation.

Grinding to reduce the particle size provides the following advantages:

1. Specific surface area of the dispersed particles is increased, and, therefore, particle wetting by the nonaqueous vehicle (liquid nonionic) is proportionately improved.
2. The average distance between dispersed particles is reduced with a proportionate increase in particle-to-particle interaction. Each of these effects contributes to increase the rest-gel strength and the suspension yield stress while at the same time, grinding significantly reduces plastic viscosity.

The yield stress is defined as the minimum stress necessary to induce a plastic deformation (flow) of the suspension. Thus, visualizing the suspension as a loose network of dispersed particles, if the applied stress is lower than the yield stress, the suspension behaves like an elastic gel and no plastic flow will occur. Once the yield stress is overcome, the network breaks at some points and the sample begins to flow, but with a very high apparent viscosity. If the shear stress is much higher than the yield stress, the pigments are partially shear-deflocculated and the apparent viscosity decreases. Finally, if the shear stress is much higher than the yield stress value, the dispersed particles are completely shear-deflocculated and the apparent viscosity is very low, as if no particle interaction were present.

Therefore, the higher the yield stress of the suspension, the higher the apparent viscosity at low shear rate and the better is the physical stability against settling of the product.

In addition to the problem of settling or phase separation, the nonaqueous liquid laundry detergents based on liquid nonionic surfactants suffer from the drawback that the nonionics tend to gel when added to cold water. This is a particularly important problem in the ordinary use of European household automatic washing machines where the user places the laundry detergent composition in a dispensing unit (e.g. a dispensing drawer) of the machine. During the operation of the machine the detergent in the dispenser is subjected to a stream of cold water to transfer it to the main body of wash solution. Especially during the winter months when the detergent composition and water fed to the dispenser are particularly cold, the detergent viscosity increases markedly and a gel forms. As a result some of the composition is not flushed completely off the dispenser during operation of the machine, and a deposit of the composition builds up with repeated wash cycles, eventually requiring the user to flush the dispenser with hot water.

The gelling phenomenon can also be a problem whenever it is desired to carry out washing using cold water as may be recommended for certain synthetic and delicate fabrics or fabrics which can shrink in warm or hot water.

The tendency of concentrated detergent compositions to gel during storage is aggravated by storing the compositions in unheated storage areas, or by shipping the compositions during winter months in unheated transportation vehicles.

Partial solutions to the gelling problem in aqueous substantially builder-free compositions have been proposed and include, for example, diluting the liquid nonionic with certain viscosity controlling solvents and gel-inhibiting agents, such as lower alkanols, e.g. ethyl alcohol (see U.S. Pat. No. 3,953,380), alkali metal formates and adipates (see U.S. Pat. No. 4,368,147), hexylene glycol, polyethylene glycol, etc. and nonionic structure modification and optimization. As an example of nonionic surfactant modification one particularly successful result has been achieved by acidifying the hydroxyl moiety end group of the nonionic molecule. The advantages of introducing a carboxylic acid at the end of the nonionic include gel inhibition upon dilution; decreasing the nonionic pour point; and formation of an anionic surfactant when neutralized in the washing liquor. Nonionic structure optimization has centered on the chain length of the hydrophobic-lipophilic moiety and the number and make-up of alkylene oxide (e.g. ethylene oxide) units of the hydrophilic moiety. For example, it has been found that a $C_{13}$ fatty alcohol ethoxylated with 8 moles of ethylene oxide presents only a limited tendency to gel formation.

Improvements are desired in the bleach properties and the stability and gel inhibition of nonaqueous liquid fabric treating compositions containing reduction bleaching systems.

BRIEF DESCRIPTION OF THE INVENTION

In accordance with the present invention a highly concentrated stable nonaqueous liquid laundry detergent composition is prepared containing an alkali metal dithionate or an alkali metal sulfite as reduction based bleaching agent.

The dithionite and sulfite reduction bleaching agents are used to replaced the conventionally used chlorine bleaches or oxygen bleaches and bleach activator systems.

The dithionite and sulfite reduction bleaching agents can be used in liquid, powder and granular detergent compositions.

The preferred alkali metals are sodium and potassium and the preferred reduction bleaching agents are sodium dithionite and sodium sulfite, with the most preferred being sodium dithionite.

In order to improve the viscosity characteristics of the composition an acid terminated nonionic surfactant can be added. To further improve the viscosity characteristics of the composition and the storage properties of the composition there can be added to the composition viscosity improving and anti gel agents such alkylene glycol mono alkyl ethers and an anti-settling agent such as an alkanol ester of phosphoric acid. In a preferred embodiment of the invention the detergent composition contains sodium dithionite reduction bleaching agent, an acid terminated nonionic surfactant, an alkylene glycol mono alkyl ether and an alkanol ester of phosphoric acid anti-settling stabilizing agent.

In an embodiment of the invention the builder components of the composition can be ground to a particle size of less than 100 microns, for example, less than 40 microns, and to preferably less than 10 microns to further improve the stability of the suspension of the builder components in the liquid nonionic surfactant detergent.

In addition other ingredients can be added to the composition such as anti-incrustation agents, sequestering agents, anti-foam agents, optical brighteners, enzymes, anti-redeposition agents, perfume and dyes.

Accordingly, in one aspect the present invention provides a liquid heavy duty laundry composition composed of a suspension of a detergent builder salt, e.g. a phosphate builder salt, in a liquid nonionic surfactant wherein the composition includes as the reduction bleaching agent an effective amount of an alkali metal dithionite or alkali metal sulfite.

According to another aspect, the invention provides a concentrated liquid heavy duty laundry detergent composition which has good bleach properties, is stable, non-settling in storage and non-gelling in storage and in use. The liquid compositions of the present invention are easily pourable, easily measured and easily put into the washing machine and are readily dispersible in water.

According to another aspect, the invention provides a method for dispensing a liquid nonionic laundry detergent composition into and/or with cold water without undergoing gelation. In particular, a method is provided for filling a container with a nonaqueous liquid laundry detergent composition in which the detergent is composed, at least predominantly, of a liquid nonionic surface active agent and for dispensing the composition from the container into an aqueous wash bath, wherein the dispensing is effected by directing a stream of unheated water onto the composition such that the composition is carried by the stream of water into the wash bath.

ADVANTAGES OVER THE PRIOR ART

The use of an alkali metal dithionite or an alkali metal sulfite in place of the conventionally used chlorine or oxygen bleaching systems provides a simple bleach system that requires fewer constituents.

Further and more importantly the reductive dithionite and sulfite bleaching systems have improved safety against damage to cellulose fiber fabrics. The oxygen based bleaching systems (e.g. perborate bleach) oxidizes cotton and the oxydation leads not only to fiber degradation, but also to encrustation and resoiling sites. The, for example, dithionite containing compositions are effective against both wine and immedial black stains and do not resoil fabrics after exposure to molecular oxygen.

The concentrated nonaqueous liquid nonionic surfactant laundry detergent compositions of the present invention have the advantages of being stable, non-settling in storage, and non-gelling in storage. The liquid compositions are easily pourable, easily measured and easily put into the laundry washing machines and are readily dispersible in water.

OBJECTS OF THE INVENTION

It is an object of the present invention to provide a stable liquid heavy duty nonaqueous nonionic detergent composition containing an alkali metal dithionite or alkali metal sulfite reduction bleaching agent, at least one viscosity control and anti-gel agent, an anti-settling stabilizing agent and an anionic phosphate detergent builder salt suspended in a nonionic surfactant.

It is an other object of the invention to provide liquid fabric treating compositions which are based on a dithionite or sulfite reduction bleaching system and which are suspensions of insoluble inorganic particles in a nonaqueous liquid and which are storage stable, easily pourable and dispersible in cold, warm or hot water.

Another object of this invention is to formulate highly built heavy duty nonaqueous liquid nonionic surfactant laundry detergent compositions which can be poured at all temperatures and which can be repeatedly dispersed from the dispensing unit of European style automatic laundry washing machines without fouling or plugging of the dispenser even during the winter months.

Another object of this invention is to provide a detergent composition which is based on a reductive bleaching system in place of an oxygen based bleaching system such that damage to cellulosic fiber fabrics due to the use of oxygen based bleaching systems is avoided.

A specific object of this invention is to provide non-gelling, stable suspensions of heavy duty built nonaqueous liquid nonionic laundry detergent composition which include an effective amount of an alkali metal dithionite or alkali metal sulfite reducing agent as the bleaching agent.

These and other objects of the invention which will become more apparent from the following detailed description of preferred embodiments are generally provided for by preparing a detergent composition comprising a nonaqueous liquid nonionic surfactant, an alkali metal dithionite or alkali metal sulfite, wherein said composition includes inorganic or organic fabric treating additives, e.g. viscosity improving agents, and one or more anti-gel agents, anti-incrustation agents, pH control agents, anti-foam agents, optical brighteners, enzymes, anti-redeposition agents, perfume and dyes.

DETAILED DESCRIPTION OF THE INVENTION

The alkali metal dithionite and alkali metal sulfite are used as a reductive bleaching system to replace the conventionally used chlorine and oxygen based bleaching systems in laundry detergent compositions.

The sodium and potassium alkali metals are preferred. The preferred reductive bleaching agents are sodium dithionite and sodium sulfite with sodium dithionite being the most preferred.

The alkali metal dithionites can be used in amounts of 2 to 25, such as 5 to 20, for example 10 to 15 percent. The alkali metal sulfites can be used in amounts of 2 to 25, such as 5 to 20, for example 10 to 15 percent.

The alkali metal dithionites and alkali metal sulfites can be used separately or in mixtures with each other.

There can also be added to the formulation stabilizers, such as, for example, an acidic organic phosphorus compound having an acidic—POH group, such as a partial ester of phosphorous acid and an alkanol.

Nonionic Surfactant Detergent

The nonionic synthetic organic detergents employed in the practice of the invention may be any of a wide variety of known compounds.

As is well known, the nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of mols of lower alkylene oxide (of 2 or 3 carbon atoms) is from 3 to 12. Of such materials it is preferred to employ those wherein the higher alkanol is a higher fatty alcohol of 9 to 11 or 12 to 15 carbon atoms and which contain from 5 to 8 or 5 to 9 lower alkoxy groups per mol. Preferably, the lower alkoxy is ethoxy but in some instances, it may be desirably mixed with propoxy, the latter, if present, often being a minor (less than 50%) proportion.

Exemplary of such compounds are those wherein the alkanol is of 12 to 15 carbon atoms and which contain about 7 ethylene oxide groups per mol, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols.

Other examples of such detergents include Tergitol 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

Also useful in the present composition as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company.

Other useful nonionics are represented by the commercially well known class of nonionics sold under the trademark Plurafac. The Plurafacs are the reaction product of a higher linear alcohol and a mixture of ethylene and propylene oxides, containing a mixed chain of ethylene oxide and propylene oxide, terminated by a hydroxyl group. Examples include products which are (A) $C_{13}$–$C_{15}$ fatty alcohol condensed with 6 moles ethylene oxide and 3 moles propylene oxide, (B) $C_{13}$–$C_{15}$ fatty alcohol condensed with 7 moles propylene oxide and 4 moles ethylene oxide, (C) $C_{13}$–$C_{15}$ fatty alcohol condensed with 5 moles propylene oxide and 10 moles ethylene oxide, and (D) which is a 1:1 mixture of products (B) and (C).

Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 mols ethylene oxide per mole of fatty alcohol.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol. Higher molecular weight alkanols and various other normally solid nonionic detergents and surface active agents may be contributory to gelation of the liquid detergent and consequently, will preferably be omitted or limited in quantity in the present compositions, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the ethoxy chain, if such branched alkyl is not more than three carbons in length. Normally, the proportion of carbon atoms in such a branched configuration will be minor rarely exceeding 20% of the total carbon atom content of the alkyl. Similarly, although linear alkyls which are terminally joined to the ethylene oxide chains are highly preferred and are considered to result in the best combination of detergency, biodegradability and non-gelling characteristics, medial or secondary joinder to the ethylene oxide in the chain may occur. It is usually in only a minor proportion of such alkyls, generally less than 20% but, as is in the cases of the mentioned Terigtols, may be greater. Also, when propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of the viscosity and gel controlling compounds of the invention can also improve the properties of the detergents based on such nonionics. In some cases, as when a higher molecular weight polylower alkoxylated higher alkanol is employed, often for its detergency, the proportional thereof will be regulated or limited in accordance with the results of routine experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures.

Another useful group of nonionic surfactants are the "Surfactant T" series of nonionics available from British Petroleum. The Surfactant T nonionics are obtained by the ethoxylation of secondary $C_{13}$ fatty alcohols having a narrow ethylene oxide distribution. The Surfactant T5 has an average of 5 moles of ethylene oxide; Surfactant T7 an average of 7 moles of ethylene oxide; Surfactant T9 an average of 9 moles of ethylene oxide and Surfactant T12 an average of 12 moles of ethylene oxide per mole of secondary $C_{13}$ fatty alcohol.

In the compositions of this invention, preferred nonionic surfactants include the $C_{12}$–$C_{15}$ secondary fatty alcohols with relatively narrow contents of ethylene oxide in the range of from about 7 to 9 moles, and the C9 to C11 fatty alcohols ethoxylated with about 5–6 moles ethylene oxide.

Mixtures of two or more of the liquid nonionic surfactants can be used and in some cases advantages can be obtained by the use of such mixtures.

Acid Terminating Nonionic Surfactant

The viscosity and gel properties of the liquid detergent compositions can be improved by including in the composition an effective amount an acid terminated liquid nonionic surfactant. The acid terminated nonionic surfactants consist of a nonionic surfactant which has been modified to convert a free hydroxyl group thereof to a moiety having a free carboxyl group, such as an ester or a partial ester of a nonionic surfactant and a polycarboxylic acid or anhydride.

As disclosed in the commonly assigned copending application Ser. No. 597,948 filed Apr. 9, 1984, the disclosure of which is incorporated herein by reference, the free carboxyl group modified nonionic surfactants, which may be broadly characterized as polyether carboxylic acids, function to lower the temperature at which the liquid nonionic forms a gel with water.

The addition of the acid terminated nonionic surfactants to the liquid nonionic surfactant aids in the dispensibility of the composition, i.e. pourability, and lowers the temperature at which the liquid nonionic surfactants form a gel in water without a decrease in their stability against settling. The acid terminated nonionic surfactant reacts in the washing machine water with the alkalinity of the dispersed builder salt phase of the detergent composition and acts as an effective anionic surfactant.

Specific examples include the half-esters of nonionic surfactant product (A) with succinic anhydride, the ester or half ester of Dobanol 25-7 with succinic anhydride, and the ester or half ester of Dobanol 91-5 with succinic anhydride. Instead of succinic anhydride, other polycarboxylic acids or anhydrides can be used, e.g. maleic acid, maleic acid anhydride, glutaric acid, malonic acid, phthalic acid, phthalic anhydride, citric acid and the like.

The acid terminated nonionic surfactants can be prepared as follows:

Acid Terminated product (A). 400 g of nonionic surfactant product (A) nonionic surfactant which is a $C_{13}$ to $C_{15}$ alkanol which has been alkoxylated to introduce 6 ethylene oxide and 3 propylene oxide units per alkanol unit is mixed with 32 g of succinic anhydride and heated for 7 hours at 100° C. The mixture is cooled and filtered to remove unreacted succinic material. Infrared analysis indicated that about one half of the nonionic surfactant has been converted to the acidic half-ester thereof.

Acid Terminated Dobanol 25-7. 522 g of Dobanol 25-7 nonionic surfactant which is the product of ethoxylation of a $C_{12}$ to $C_{15}$ alkanol and has about 7 ethylene oxide units per molecule of alkanol is mixed with 100 g of succinic anhydride and 0.1 g of pyridine (which acts as an esterification catalyst) and heated at 260° l C. for 2 hours, cooled and filtered to remove unreacted succinic material. Infrared analysis indicates that substantially all the free hydroxyls of the surfactant have reacted.

Acid Terminate Dobanol 91-5. 1000 of Dobanol 91-5 nonionic surfactant which is the product of ethoxylation of a $C_9$ to $C_{11}$ alkanol and has about 5 ethylene oxide units per molecule of alkanol is mixed with 265 g of succinic anhydride and 0.1 g of pyridine catalyst and heated at 260° C. for 2 hours, cooled and filtered to remove unreacted succinic material. Infrared analysis indicates that substantially all the free hydroxyls of the surfactant have reacted.

Other esterification catalysts, such as an alkali metal alkoxide (e.g. sodium methoxide) may be used in place of, or in admixture with, the pyridine.

The acidic polyether compound, i.e. the acid terminated nonionic surfactant is preferably added dissolved in the nonionic surfactant.

BUILDER SALTS

The liquid nonaqueous nonionic surfactant used in the compositions of the present invention has dispersed and suspended therein fine particles of inorganic and/or inorganic detergent builder salts.

The invention detergent compositions include water soluble and/or water insoluble detergent builder salts. Water soluble inorganic alkaline builder salts which can be used alone with the detergent compound or in admixture with other builders are alkali metal carbonates, bicarbonates, borates, phosphates, polyphosphates, and silicates. (Ammonium or substituted ammonium salts can also be used.) Specific examples of such salts are sodium tripolyphosphate, sodium carbonate, sodium tetraborate, sodium pyrophosphate, potassium pyrophosphate, sodium bicarbonate, potassium tripolyphosphate, sodium hexametaphosphate, sodium sesquicarbonate, sodium mono and diorthophosphate, and potassium bicarbonate. Sodium tripolyphosphate (TPP) is especially preferred.

Since the compositions of this invention are generally highly concentrated, and, therefore, may be used at relatively low dosages, it is desirable to supplement any phosphate builder (such as sodium tripolyphosphate) with an auxiliary builder such as a poly lower carboxylic acid or a polymeric carboxylic acid having high calcium binding capacity to inhibit incrustation which could otherwise be caused by formation of an insoluble calcium phosphate.

A suitable lower poly carboxylic acid comprises alkali metal salts of lower polycarboxylic acids, preferably the sodium and potassium salts. Suitable lower polycarboxylic acids have two to four carboxylic acid groups. The preferred sodium and potassium lower polycarboxylic acids salts are the citric and tartaric acid salts. The sodium citric acid salts are the most preferred, especially the trisodium citrate. The monosodium and disodium citrates can also be used. The monosodium and disodium tartaric acid salts can also be used. The alkali metal lower polycarboxylic acid salts are particularly good builder salts; because of their high calcium and magnesium binding capacity they inhibit incrustation which could otherwise be caused by formation of insoluble calcium and magnesium salts.

Other organic builders are polymers and copolymers of polyacrylic acid and polymaleic anhydride and the alkali metal salts thereof. More specifically such builder salts can consist of a copolymer which is the reaction product of about equal moles of methacrylic acid and maleic anhydride which has been completely neutralized to form the sodium salt thereof. The builder is commercially available under the tradename of Sokalan CP5. This builder serves when used even in small amounts to inhibit incrustation.

Examples of organic alkaline sequestrant builder salts which can be used with the detergent builder salts or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA), and triethanolammonium N-(2-hydroxyethyl)nitrilodiacetates. Mixed salts of these aminopolycarboxylates are also suitable.

Other suitable builders of the organic type include carboxymethylsuccinates, tartronates and glycollates. Of special value are the polyacetal carboxylates. The polyacetal carboxylates and their use in detergent compositions are described in application Ser. No. 767,570, filed Aug. 19, 1985, assigned to applicants' assignee and in a U.S. Pat. Nos. 4,144,226, 4,315,092 and 4,146,495.

The alkali metal silicates are useful builder salts which also function to adjust or control the pH and to make the composition anticorrosive to washing machine parts. Sodium silicates of $Na_2O/SiO_2$ ratios of from 1.6/1 to 1/3.2, especially about ½ to 1/2.8 are preferred. Potassium silicates of the same ratios can also be used.

Other typical suitable builders include, for examle, those disclosed in U.S. Pat. Nos. 4,316,812, 4,264,466 and 3,630,929. The inorganic builder salts can be used with the nonionic surfactant detergent compound or in admixture with other inorganic builder salts or with organic builder salts.

The water insoluble crystalline and amorphous aluminosilicate zeolites can be used. The zeolites generally have the formula $$(M_2O)_x.(Al_2O_3)_y.(SiO_2)_z.wH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq 1 g.

Various crystalline zeolites (i.e. alumino-silicates) that can be used are described in British Pat. No. 1,504,168, U.S. Pat. No. 4,409,136 and Canadian Pat. Nos. 1,072,835 and 1,087,477, all of which are hereby incroporated by reference for such descriptions. An example of amorphous zeolites useful herein can be found in Belgium Pat. No. 835,351 and this patent too is incorporated herein by reference.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc., may be loosely combined. The bentonite in its more purified form (i.e. free from any grit, sand, etc.) suitable for detergents contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Pat. No. 401,413 to Marriott and British Pat. No. 461,221 to Marriott and Guan.

Viscosity Control and Anti Gel Agents

The inclusion in the detergent composition of an effective amount of low molecular weight amphiphilic compounds which function as viscosity control and gel inhibiting agents for the nonionic surfactant substantially improves the storage properties of the composition. The viscosity control and gel inhibiting agents act to lower the temperature at which the nonionic surfactant will form a gel when added to water. Such viscosity control and gel inhibiting agents can be, for example, low molecular weight alkylene oxide lower mono-alkyl ether amphilic compounds. The amphiphilic compounds can be considered to be analagous in chemical structure to the ethoxylated and/or propoxylated fatty alcohol liquid nonionic surfactants but have relatively short hydrocarbon chain lengths ($C_2$ to $C_8$) and a low content of ethylene oxide (about 2 to 6 ethylene oxide groups per molecule).

Suitable amphiphilic compounds are represented by the following general formula $$R^1O(\overset{\overset{\displaystyle R^2}{|}}{C}HCH_2O)_nH$$

where $R^1$ is a $C_2$–$C_8$ alkyl group, $R^2$ is hydrogen or methyl, and n is a number of from about 1 to 6, on average.

Specifically the compounds are lower ($C_2$ to $C_3$) alkylene glycol mono lower ($C_2$ to $C_5$) alkyl ethers.

More specifically the compounds are mono-, di- or tri-lower ($C_2$ to $C_3$) alkylene glycol mono lower ($C_1$ to $C_5$) alkyl ethers.

Specific examples of suitable amphiphilic compounds include ethylene glycol monoethyl ether $C_2H_5$—O—$CH_2CH_2OH$, diethylene glycol monobutyl ether $C_4H_9$—O—$(CH_2CH_2O)_2H$, tetraethylene glycol monobutyl ether $C_4H_7$—O—$(CH_2CH_2O)_4H$ and dipropylene glycol monomethyl ether $$CH_3—O—(\underset{\underset{\displaystyle CH_3}{|}}{C}HCH_2O)_2H.$$

Diethylene glycol monobutyl ether is especially preferred.

The inclusion in the composition of the low molecular weight lower alkylene glycol mono alkyl ether decreases the viscosity of the composition, such that it is more easily pourable, improves the stability against settling and improves the dispersibility of the composition on the addition to warm water or cold water.

The compositions of the present invention have improved viscosity and stability characteristics and remain stable and pourable at temperatures as low as about 5° C. and lower.

In an embodiment of this invention a stabilizing agent which is an alkanol ester of phosporic acid can be added to the formulation. Improvements in stability of the composition may be achieved by incorporation of a small effective amount of an acidic organic phosphorus compound having an acidic—POH group, such as a partial ester of phosphorous acid and an alkanol. As disclosed in the commonly assigned copending application Ser. No. 597,948 filed Apr. 9, 1984 the disclosure of which is incorporated herein by reference, the acidic organic phosphorous compound having an acidic—POH group can increase the stability of the suspension of builders in the nonaqueous liquid nonionic surfactant. The acidic organic phosphorus compound may be, for instance, a partial ester of phosphoric acid and an alcohol such as an alkanol which has a lipophilic character, having, for instance, more than 5 carbon atoms, e.g. 8 to 20 carbon atoms.

A specific example is a partial ester of phosphoric acid and a $C_{16}$ to $C_{18}$ alkanol (Empiphos 5632 from Marchon); it is made up of about 35% monoester and 65% diester.

The inclusion of quite small amounts, e.g. 0.3% by weight, of the acidic organic phosphorus compound makes the suspension stable against settling on standing but remains pourable, while, for the low concentration of stabilizer, e.g. below about 1%, its plastic viscosity will generally decrease.

The conventionally used chlorine and oxygen based bleaching agents, peroxygen bleach activators, bleach sequestering agents and enzyme inhibitor compounds (to prevent enzyme induced decomposition of the peroxygen bleach) are not needed in the present invention based on a reductive bleaching system.

In addition to the detergent builders, various other detergent additives or adjuvants may be present in the detergent product to give it additional desired properties, either of functional or aesthetic nature. Thus, there may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxymethyl cellulose having a 2:1 ratio of CMC/MC which is sold under the tradename Relatin DM 4050.

There may also be included in the composition small amounts of Duet 787 which is fragrance, i.e. perfume, and which is supplied by International Flavors and Fragrances, Inc., Union Beach, N.J. 07735. The Duet 787 can be added in amounts such as 0 to 3, preferrably 0.2 to 2.0, e.g. 0.5 to 2.0 percent such as 0.3 to 1.0 percent by weight of the composition.

Optical brighteners for cotton, polyamide and polyester fabrics can be used. Suitable optical brighteners include stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene N4 which is a dianilinodimorpholino stilbene polysulfonate.

Enzymes, preferably proteolytic enzymes, such as subtilisin, bromelin, papain, trypsin and pepsin, as well as amylase type anzymes, lipase type enzymes, and mixtures thereof can be added. Preferred enzymes include protease slurry, esperase slurry and amylase. A preferred enzyme is Esperse SL8 which is a proteolytic enzyme. Anti-foam agents, e.g. silicon compound, such as Silicane L 7604, which is polysiloxane can also be added in small effective amounts.

Bactericides, e.g. tetrachlorosalicylanilide and hexachlorophene, fungicides, dyes, pigments (water dispersible), preservatives, ultraviolet absorbers, anti-yellowing agents, such as sodium carboxymethyl cellulose, pH modifiers and pH buffers, color safe bleaches, perfume, and dyes and bluing agents such as ultramarine blue can be used.

The composition may also contain an inorganic insoluble thickening agent or dispersant of very high surface area such as finely divided silica of extremely fine particle size (e.g. of 5–100 millimicrons diameters such as sold under the name Aerosil) or the other highly voluminous inorganic carrier materials disclosed in U.S. Pat. No. 3,630,929, in proportions of 0.1–10%, e.g. 1 to 5%. It is preferable, however, that compositions which form peroxyacids in the wash bath (e.g. compositions containing peroxygen compound and activator therefor) be substantially free of such compounds and of other silicates; it has been found, for instance, that silica and silicates promote the undesired decomposition of the peroxyacid.

In an embodiment of the invention the stability of the builder salts in the composition during storage and the dispersibility of the composition in water is improved by grinding and reducing the particle size of the solid builders to less than 100 microns, preferably less than 40 microns and more preferably to less than 10 microns. The solid builders, e.g. sodium tripolyphosphate (TPP), are generally supplied in particle sizes of about 100, 200 or 400 microns. The nonionic liquid surfactant phase can be mixed with the solid builders prior to or after carrying out the grinding operation.

In a preferred embodiment of the invention, the mixture of liquid nonionic surfactant and solid ingredients is subjected to an attrition type of mill in which the particle sizes of the solid ingredients are reduced to less than about 10 microns, e.g. to an average particle size of 2 to 10 microns or even lower (e.g. 1 micron). Preferably less than about 10%, especially less than about 5% of all the suspended particles have particle sizes greater than 10 microns. Compositions whose dispersed particles are of such small size have improved stability against separation or settling on storage. Addition of the acid terminated nonionic surfactant compound can decrease the yield stress of such dispersions and aid in the dispersibility of the dispersions without a corresponding decrease in the dispersions stability against settling.

In the grinding operation, it is preferred that the proportion of solid ingredients be high enough (e.g. at least about 40% such as about 50%) that the solid particles are in contact with each other and are not substantially shielded from one another by the nonionic surfactant liquid. After the grinding step any remaining liquid nonionic surfactant can be added to the ground formulation. Mills which employ grinding balls (ball mills) or similar mobile grinding elements have given very good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill, it is desirable to pass the blend of nonionic surfactant and solids first through a mill which does not effect such fine grinding (e.g. a colloid mill) to reduce the particle size to less than 100 microns (e.g. to about 40 microns) prior to the step of grinding to an average particle diameter below about 10 microns in the continuous ball mill.

In the preferred heavy duty liquid laundry detergent compositions of the invention, typical proportions (percent based on the total weight of composition, unless otherwise specified) of the ingredients are as follows:

Liquid nonionic surfactant detergent in the range of about 10 to 60, such as 20 to 50 percent, e.g. about 30 to 40 percent.

Acid terminated nonionic surfactant viscosity improving agent in an amount in the range of about 0 to 20, such as 1 to 10 percent, e.g. about 2 to 6.

Detergent builder, such as sodium tripolyphosphate (TPP), in the range of about 10 to 60, such as 15 to 50 percent, e.g. about 25 to 35 percent.

Alkali metal silicate in the range of about 0 to 30 , such as 5 to 25 percent, e.g. about 10 to 20 percent.

Copolymer of polyacrylate and polymaleic anhydride alkali metal salt, e.g. Sokalan CP5, anti-incrustation agent in the range of about 0 to 10, such as 1 to 6 percent, e.g. about 2 to 4 percent.

Alkylene glycol monoalkylether anti-gel agent in an amount in the range of about 5 to 30, such as 5 to 20 percent, e.g. about 5 to 15 percent.

The alkali metal dithionite in an amount of 2 to 25, such as 5 to 20, for example 10 to 15 percent.

The alkali metal sulfites in an amount fo 2 to 25, such as 5 to 20, for example 10 to 15 percent.

Phosphoric acid alkanol ester stabilizing agent in the range of 0 to 2.0 or 0.1 to 1.0, such as 0.2 to 0.5 percent.

Sequestering agent for bleach, e.g. Dequest 2066, in the range of about 0 to 3.0, preferably 0.5 to 2.0 percent, e.g. about 0.75 to 1.25 percent.

Anti-redeposition agent, e.g. Relatin DM 4050, in the range of about 0 to 4.0, preferably 0.5 to 3.0 percent, e.g. 0.5 to 1.5 percent.

Optical brightener in the range of about 0 to 2.0, preferably 0.05 to 1.0 percent, e.g. 0.15 to 0.75 percent.

Enzymes in the range of about 0 to 3.0, preferrably 0.5 to 2.0 percent, e.g. 0.75 to 1.25 percent.

Perfume in the range of about 0 to 3.0, preferably 0.10 to 1.25 percent, e.g. 0.25 to 1.0 percent.

Various of the previously mentioned additives can optionally be added to achieve the desired function of the added materials.

The alkali metal dithionite reduction bleaching agent is preferably use with at least one of the alkylene glycol mono-ether or the acid terminated nonionic surfactant viscosity control and anti-gel agents. In some cases advantages can be obtained by using both the alkylene glycol mono-ether and the acid terminated nonionic surfactants.

In the selection of the additives, they will be chosen to be compatible with the main constituents of the detergent composition. In this application, as mentioned above, all proportions and percentages are by weight of the entire formulation or composition unless otherwise indicated.

The concentrated nonaqueous nonionic liquid detergent composition of the present invention dispenses readily in the water in the washing machine.

In an embodiment of the invention the detergent composition of a typical formulation is formulated using the below named ingredients:

| | Weight % |
|---|---|
| Nonionic surfactant detergent. | 30–40 |
| Acid terminated surfactant viscosity improving agent. | 0–20 |
| Phosphate detergent builder salt. | 10–60 |
| Anti-incrustation agent. | 0–10 |
| Alkylene glycol monoalkylether anti-gel agent. | 5–15 |
| Phosphoric acid alkanol ester stabilizing agent | 0.0–2.0 |
| Anti-redeposition agent. | 0–4.0 |
| Alkali metal dithionite | 5–20 |
| Optical brightener. | 0.15–0.75 |
| Enzymes. | 0.75–1.25 |
| Perfume (Duet 787). | 0–3.0 |

The present invention is further illustrated by the following examples.

EXAMPLE 1

A concentrated nonaqueous liquid nonionic surfactant detergent composition is formulated from the following ingredients in the amounts specified.

| | Weight % |
|---|---|
| Nonionic surfactant Product D. | 33.0 |
| Acid terminated Dobanol 91-5 reaction product with succinic anhydride. | 5.0 |
| Sodium tri polyphosphate (TPP). | 28.6 |
| Diethylene glycol monobutylether anti-gel agent. | 10 |
| Phosphoric acid alkanol ester (Emphiphos 5632). | 0.3 |
| Sodium sulfite. | 16.0 |
| Anti-incrustation agent (Sokalin CP5) | 4.0 |
| Anti-redeposition agent (Relatin DM 4050)(1) | 1.0 |
| Duet 787(2) | 0.6 |
| Optical brightener (Stilbene). | 0.5 |
| Enzyme (which is Esperase). | 1.0 |
| | 100.0 |

(1)CMC/MC 2:1 mixture of sodium carboxymethyl cellulose and hydroxymethylcellulose.
(2)Duet 787 which is a perfume from IFF, Inc.

The formulation is ground for about 1.0 hour to reduce the particle size of the suspended builder salts to less than 1.0 microns. The formulated detergent composition is found to be stable and non-gelling in storage and readily dispersible in water and to have good bleach properties.

EXAMPLE 2

A concentrated nonaqueous liquid nonionic surfactant detergent composition is formulated from the following ingredients in the amounts specified.

| | Weight % |
|---|---|
| Nonionic Surfactant Product D. | 35 |
| Acid Terminated Dobanol 91-5 reaction product with succinic anhydride. | 5 |
| Sodium tri-polyphosphate (TPP). | 30.6 |
| Anti-incrustation agent (Sokalan CP5). | 4.0 |
| Diethylene glycol monobutylether anti-gel agent. | 10 |
| Phosphoric acid alkanol ester (Empiphos 5632) | 0.3 |
| Sodium dithionite. | 12 |
| Anti-redeposition agent (Relatin DM 4050)(1). | 1.0 |
| Optical brighteners (Stilbene). | 0.5 |
| Enzyme (Esperase slurry). | 1.0 |
| Duet 787(2) | 0.6 |

-continued

| | Weight % |
|---|---|
| | 100.0 |

(1)CMC/MC 2:1 mixture of sodium carboxymethyl cellulose and hydroxymethylcellulose.
(2)Duet 787 which is a perfume from IFF, Inc.

The formulation is ground for about 1 hour to reduce the particle size of the suspended builder salts to less than 40 microns. The formulated detergent composition is found to be stable and non-gelling in storage and readily dispersible in water. The detergent composition containing the dithionite reduction bleaching agent was effective on both wine and immedial black stains. The bleach stains were tested and no resoiling after exposure to molecular oxygen was observed.

The formulations of Examples 1 and 2 can be prepared without grinding the builder salts and suspended solid particles to a small particle size, but best results are obtained by grinding the formulation to reduce the particle size of the suspended solid particles.

The builder salts can be used as provided or the builder salts and suspended solid particles can be ground or partially ground prior to mixing them with the nonionic surfactant. The grinding can be carried out in part prior to mixing and grinding completed after mixing or the entire grinding operation can be carried out after mixing with the liquid surfactant. The formulations containing suspended builder and solid particles less than 40 microns in size are preferred.

The compositions were ground in an Attrotor mill for laboratory batches. Commercial production can be obtained with a Co Ball Mill.

The alkali metal dithionite and alkali metal sulfite reduction bleach systems of the present invention can also be used in nonionic surfactant detergent dishwashing compositions, cream scourers, and other compositions in which bleaching is required such as dry powder and dry granular detergent compositions.

It is understood that the foregoing detailed description is given merely by way of illustration and that variations may be made therein without departing from the spirit of the invention.

What is claimed is:

1. A nonaqueous liquid heavy duty built laundry detergent composition which comprises 20 to 50 percent of a nonionic liquid surfactant detergent, 15 to 50 percent of a detergent builder and 2 to 25 percent of a reduction bleaching agent which is a member selected from the group of alkali metal dithionite and alkali metal sulfite.

2. The composition of claim 1 which comprises alkali metal dithionite as the reduction bleaching agent.

3. The composition of claim 1 which comprises alkali metal sulfite as the reduction bleaching agent.

4. A nonaqueous liquid heavy duty, built laundry detergent composition which is pourable at high and low temperatures and does not gel when mixed with cold water, said composition consisting essentially of at least one liquid nonionic surfactant in an amount of from about 10 to 60 percent by weight;

at least one inorganic detergent builder salt suspended in the nonionic surfactant in an amount of from about 10 to about 60 percent by weight;

an alkali metal dithionite reduction bleaching agent in an amount of from about 2 to 25 percent by weight; and a compound of the formula $$RO(\overset{\overset{R^2}{|}}{C}HCH_2O)_nH$$

where $R^1$ is a $C_2$ to $C_8$ alkyl group, $R^2$ is hydrogen or methyl, and n is a number having an average value in the range of from about 1 to 6, as a gel inhibiting additive in an amount up to about 5 to 30 percent by weight.

5. The detergent composition of claim 4 which contains, one or more of the following detergent adjuvants: anti-incrustation agent, anti-redeposition agent, optical brightener, enzyme and perfume.

6. A nonaqueous liquid heavy duty laundry detergent composition of claim 4 which comprises:

| | Weight % |
|---|---|
| Nonionic surfactant in an amount of about | 20–50 |
| Acid terminated nonionic surfactant viscosity improving agent in an amount of about | 1–10 |
| Sodium tripolyphosphate (TPP) in an amount of about | 15–50 |
| Copolymer of polyacrylate and polymaleic anhydride sodium salt in an amount of about | 1–6 |
| Diethylene glycol monoalkylether in an amount of about | 5–20 |
| Phosphoric acid alkanol ester in an amount of about | 0–2.0. |

7. A nonaqueous liquid heavy duty laundry detergent composition of claim 4 which comprises:

| | Weight % |
|---|---|
| Nonionic surfactant in an amount of about | 30–40 |
| Acid terminated nonionic surfactant viscosity improving agent in an amount of about | 2–6 |
| Sodium tripolyphosphate in an amount of about | 25–35 |
| Copolymer of polyacrylate and polymaleic anhydride sodium salt in an amount of about | 2–4 |
| Diethylene glycol monobutylether in an amount of about | 5–15 |
| Phosphoric acid alkanol ester in an amount of about | 0.2–0.5 |
| Anti-redeposition agent in an amount of about | 0.5–1.5. |

8. A method for cleaning soiled fabrics which comprises contacting the soiled fabrics with the detergent composition of claim 1.

9. The method for cleaning soiled fabrics of claim 8 which comprises contacting the soiled fabrics with the laundry detergent composition of claim 4.

10. The method of claim 8 for cleaning soiled fabrics which comprises contacting the soiled fabrics with the laundry detergent composition of claim 6.

11. The method of claim 8 for cleaning soiled fabrics which comprises contacting the soiled fabrics with the laundry detergent composition of claim 7.

12. A nonaqueous liquid heavy duty, built laundry detergent composition which is pourable at high and low temperatures and does not gel when mixed with cold water, said composition comprising at least one liquid nonionic surfactant in an amount of from about 20 to 50 percent by weight;

at least one detergent builder suspended in the nonionic surfactant in an amount of from about 15 to about 50 percent by weight;

an alkali metal dithionite reduction bleaching agent in an amount of from about 2 to 25 percent by weight; and a gel inhibiting additive in an amount of about 5 to 20 percent by weight.

13. The composition of claim 12 comprising an alkylene glycol mono-alkyl ether as the gel inhibiting additive.

14. The composition of claim 12 comprising an alkali metal polyphosphate as the detergent builder.

15. A nonaqueous liquid heavy duty, built laundry detergent composition which is pourable at high and low temperatures and does not gel when mixed with cold water, said composition comprising at least one liquid nonionic surfactant in an amount of from about 20 to 50 percent by weight;

at least one detergent builder suspended in the nonionic surfactant in an amount of from about 15 to about 50 percent by weight;

an alkali metal sulfite reduction bleaching agent in an amount of from about 2 to 25 percent by weight; and a gel inhibiting additive in an amount up to about 5 to 30 percent by weight.

16. The composition of claim 15 comprising an alkylene glycol mono-alkyl ether as the gel inhibiting additive.

17. The composition of claim 15 comprising an alkali metal polyphosphate as the detergent builder.

18. A powdered or granular detergent composition which comprises at least one nonionic surfactant detergent in an amount of about 20 to 50 percent by weight, at least one detergent builder in an amount of about 15 to 50 percent by weight; and an alkali metal dithionite reduction bleaching agent in an amount of about 2 to 25 percent by weight.

19. The composition of claim 18 comprising an alkali metal polyphosphate as the detergent builder.

20. A method for cleaning soiled fabrics which comprises contacting the soiled fabrics with the detergent composition of claim 18.

21. A nonaqueous liquid heavy duty, built laundry detergent composition which is pourable at high and low temperatures and does not gel when mixed with cold water, said composition consisting essentially of at least one liquid nonionic surfactant in an amount of from about 10 to 60 percent by weight;

at least one inorganic detergent builder salt suspended in the nonionic surfactant in an amount of from about 10 to about 60 percent by weight;

an alkali metal sulfite reduction bleaching agent in an amount of from about 2 to 25 percent by weight; and a compound of the formula $$RO(\overset{\overset{R^2}{|}}{C}HCH_2O)_nH$$

where $R^1$ is a $C_2$ to $C_8$ alkyl group, $R^2$ is hydrogen or methyl, and n is a number having an average value in the range of from about 1 to 6, as a gel inhibiting additive in an amount up to about 5 to 30 percent by weight.

* * * * *